United States Patent [19]

Moore et al.

[11] Patent Number: 4,863,573

[45] Date of Patent: Sep. 5, 1989

[54] ABRASIVE ARTICLE

[75] Inventors: Michael W. Moore; Ian Gorsuch, both of Kent, England

[73] Assignee: Interface Developments Limited, Kent, England

[21] Appl. No.: 147,800

[22] Filed: Jan. 25, 1988

[30] Foreign Application Priority Data

Jan. 24, 1987 [GB] United Kingdom ..... 8701553

[51] Int. Cl.[4] ..... C25D 15/00

[52] U.S. Cl. ..... 204/16

[58] Field of Search ..... 204/13, 15, 16

[56] References Cited

U.S. PATENT DOCUMENTS 2,820,746 1/1958 Keeleric ..... 204/16

*Primary Examiner*—T. M. Tufariello

*Attorney, Agent, or Firm*—Gifford, Groh, Sheridan, Sprinkle and Dolgorukov

[57] ABSTRACT

In a method of forming an abrasive article a mesh material is applied with insulating material over areas which do not require abrasive, the insulating material being absorbed into the mesh material. The mesh material is then laid onto a surface of electrically conducting material and metal is electro-deposited onto the discrete areas of the mesh not bearing the insulating material. Abrasive is added so that it becomes embedded in the metal. The resulting material with metal and abrasive areas is stripped off the surface. The preferred insulating materials are ink screen printed onto the mesh, or hot melt adhesive perforated to define openings and then applied to the mesh to penetrate the mesh.

12 Claims, 1 Drawing Sheet

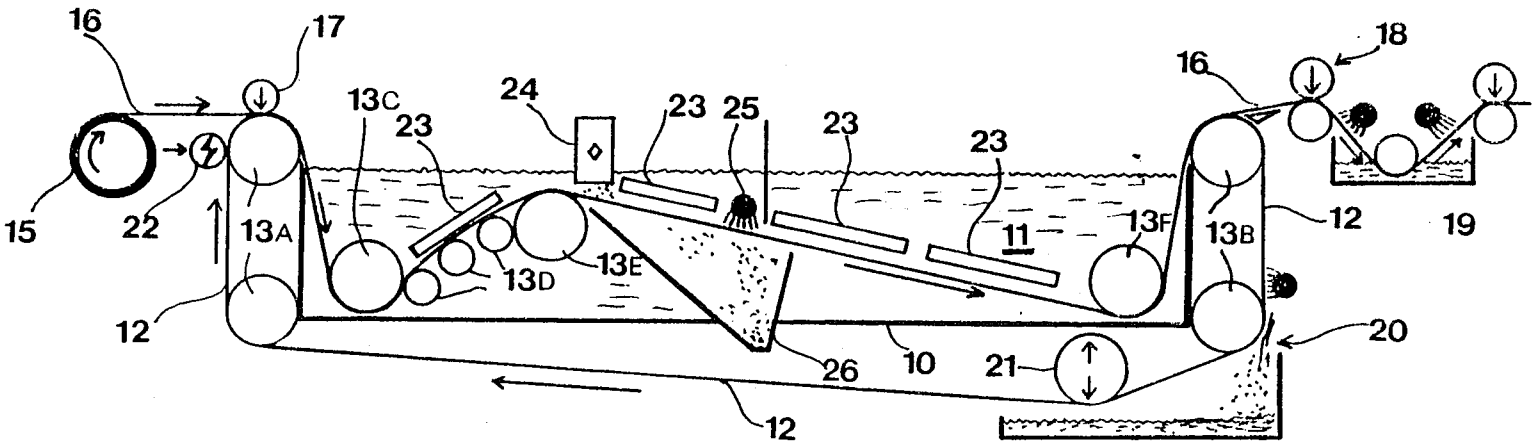
15
16
17
22
13A
12
13C
23
24
13D
13E
25
23
23
11
10
26
12
13F
21
13B
16
18
12
20
19

ABRASIVE ARTICLE

This invention relates to a method of making abrasive articles and to abrasive articles made according to the method.

It has been proposed to make abrasive articles by laying a length of mesh material onto an electrically conductive surface and electro depositing a layer of metal onto the surface and through the openings in the mesh material in the presence of abrasive material. When the mesh material is stripped off the conductive surface it carries the metal layer with the abrasive material embedded in the layer. Such a method is described in European Pat. No. 0013486.

In order that only discrete areas of the mesh material carry the metal with embedded abrasive a previous manner of achieving this was to apply the conductive surface with electrically insulating material over selected areas of the surface so that the metal is deposited on the mesh material only over the remaining discrete areas of the surface.

An object of the invention is to provide an improved method of forming an abrasive article and an improved article formed by the method.

According to one aspect the invention provides a method of making an abrasive article in which a length of mesh material is laid onto a smooth electrically conducting surface, metal is electro-deposited onto discrete areas of said surface and thereby onto and through discrete areas of the mesh material in the presence of abrasive material so that the abrasive material becomes embedded in the discrete areas of metal and the metal is adhered to the mesh, the mesh material being applied with insulating material over areas of the mesh material before application to said surface so that the metal is only deposited over the remaining discrete areas of the mesh, and after application of the metal and abrasive to the mesh material the mesh material is stripped off said surface to constitute the abrasive article.

Preferably the insulating material is applied to said mesh material so that it penetrates into and fills the openings in the mesh and leaves areas of the mesh without insulating material on which areas the metal is to be deposited into the openings in the mesh.

Conveniently the insulating material is waterproof, acid resistant and stable at elevated temperatures at which the article is intended to be operated.

In one arrangement the insulating material is screen printed onto the mesh material to define said discrete areas of the mesh which are without insulating material and in this case the material may be oil-based ink.

Alternatively the insulating material is hot melt adhesive and this may be applied to the mesh in sheet form under heat, the sheet being formed with openings of the shape of the desired discrete areas before applications to the mesh. The sheet adhesive may be applied to the mesh material under heat so that the adhesive melts onto the mesh material and fills the openings, the melt temperature of the adhesive being above the operating temperature of the abrasive article. The abrasive member may be applied with a backing member after removal from said surface, the backing member being adhered to the abrasive member by said adhesive.

According to another aspect of the invention there is providing an abrasive article which comprises mesh material, discrete areas of electro-deposited metal extending through and carried on the mesh material and having abrasive material embedded in the metal, the remaining area of the mesh material having insulating material penetrating into the mesh and filling openings in the mesh.

In one method of making an abrasive article according to the invention mesh material in the form of a woven fabric of electrically insulating material such as nylon, terylene or the like is screen printed with insulating material in the form of ink. The ink is waterproof and acid resistant and in its preferred form is colour fast at elevated working temperatures of the abrasive article, for example up to approximately 220° C. The ink should be compatible with hot melt adhesive which may be subsequently applied to the article. The ink may be resin based or oil based ink coloured as desired.

The screen printing may be conducted by conventional screen printing techniques in a manner to ensure that the ink penetrates into and is absorbed onto defined areas of the mesh material leaving discrete areas without any insulating material. Such discrete areas may be of any convenient shape and size. Thus the areas may be circular, diamond-shaped, rectangular, or the like.

The mesh material, for example in a roll, with the dried insulating material thereon is laid under tension on a smooth electrically conductive surface for electrodeposition of metal onto the discrete areas of the mesh not carrying the insulating material. The surface may be the surface of a cylinder about which the mesh is wrapped or it may be an endless band of stainless steel or other electrically-conductive metal passing over drive means.

The cylinder or the band is immersed in an electrolyte bath containing a metal electrolyte of metal capable of being electroplated or electroless plated, usually nickel or copper.

During electro-deposition metal is deposited onto the mesh only over those areas not carrying the insulating material. During deposition the metal is deposited onto said areas so that the mesh is embedded in the metal and deposition continues until almost the full desired thickness of metal is achieved. Abrasive particles in the form of diamond, cubic boron nitride or other suitable abrasive material are then introduced into the bath in suspension whereupon such material becomes deposited on the metal. Further deposition of metal then takes place and the particles become embedded in the outer layer of the metal and lie at the surface of the metal.

When deposition is complete the mesh is removed or stripped from the cylinder or band and consists of an abrasive article having discrete areas of metal in which the mesh is embedded, on one surface the metal carrying abrasive particles.

The abrasive article thus produced is usually adhered to a backing member, for example a backing sheet of woven material, by applying a layer of adhesive to the article or the backing sheet and heating the adhesive to adhere the article to the sheet. In a further operation the resulting assembly of article and backing sheet may be attached to a flexible belt, rigid block or other carrying member.

In another method the ink may be combined with an adhesive and screen printed onto the mesh material. The metal is deposited, as previously described, and the resulting article may be applied with a backing member by heating the article to melt the adhesive content of the insulating material and adhering the backing member to the article. When the electrically conductive surface is an endless band the deposition of metal on the mesh material may be a continuous process. A roll of the mesh material is laid on the band at one end of an operative run of the band and, as the band is moved through the electrolyte, the metal deposition takes place. The abrasive particles are added to the electrolyte towards the end of said run to be included in the final layer of deposited metal and, when the band reaches the end of its run, the mesh material is stripped off the band. Thus the band is able to be passed continuously through the electrolyte bath and a continuous length of the mesh material is applied with the discrete areas of metal and abrasive during its passage.

In another method instead of the insulating material being ink or an ink and adhesive combination adhesive only may be used as the insulating material. In this case the adhesive may be in the form of a sheet which is applied to the mesh material before electro-deposition. Usually the adhesive sheet will be perforated and thereby formed with a plurality of openings of the desired shape and size before application to the mesh material. Preferably this perforation will be by cutting out the openings from the sheet by any convenient means.

The adhesive sheet with its openings is then heated when in contact with the mesh material and pressure is applied to cause the adhesive to be absorbed and enter the spaces in the mesh. When fully penetrating the mesh the adhesive is cooled.

The mesh and adhesive is then caused to be electro-deposited with metal and abrasive over the discrete open areas in the manner previously described.

The resulting abrasive article of the latter method has adhesive at both sides of the mesh material and surrounding the metal areas and it can be readily adhered to a backing material by applying the backing material to the rear surface and heating to cause the adhesive to adhere the mesh to the backing.

The adhesive is a hot melt adhesive which is acid resistant and water repellant to be unaffected by the electrolyte.

For high temperature applications of the abrasive article such as in abrasive belts the adhesive should have a melting point above the working temperature for example at or above about 220° C. For lower temperature applications the melting point may be 120° C. or above. A polyester based hot melt film adhesive has been found suitable for use in this method.

The mesh material used may be flexible if the abrasive article is to have flexible properties, such as in abrasive belts, but if the article is to be rigid, such as in abrasive laps, the mesh material may be of rigid or semi-rigid construction.

Although it is preferred that the mesh material is non-conducting it is possible to use a conducting mesh material with the methods described, the insulating material rendering the areas of the mesh to which metal is not to be applied, non-conducting. Such a conducting mesh material may be of metallic woven material.

The methods described offer significant advantages over previous methods. In comparison with the prior method employing a cylinder with insulating applied to its surface to define the discrete areas of electro-deposition there is now the facility to use a plain cylinder or the continuous plain band arrangement described. Thus a wide variety of abrasive articles, limited only by the availability of screens able to print to the desired areas, is possible. When using perforated sheet adhesive any arrangement of openings can be used in the sheet. Moreover the size of the abrasive article is not subject to the same limitations as hitherto especially when using an endless band arrangement.

Further features of apparatus for use in the method of invention appear from the following description given by way of example only and with reference to the drawing which is a diagrammatic longitudinal cross section.

Referring to the drawing a tank 10 contains suitable electrolyte 11. An endless band 12 of electrically conductive material is driven and guided along a path which takes the band 12 through the tank 10 over an operative portion of its travel.

Guidance of the band 12 is by means of a series of rollers 13, one or more of which are drive rollers. Two rollers 13A are at the input end of the tank and two rollers 13B are at the output end of the tank. Rollers 13C, 13D, 13E and 13F within the tank guide the band over the operative portion of its travel.

A roll 15 of the mesh material is located at the input end of the tank 10 and the length of mesh 16 from a roll 15 is laid under tension onto the top surface of the band 12 as it passes over the upper roller 13A at the input end. The mesh is pressed against roller 13A by a further roller 17.

The mesh is then maintained in contact with the upper surface of the band over the operative portion while deposition of metal and abrasive takes place (as described) on the discrete areas of the mesh not carrying the insulating material. As the band 12 with its overlying mesh 16 leaves the tank 10 at the output end and passes over the upper output roller 13B, the mesh 16 with discrete areas of metal and abrasive attached thereto is stripped or peeled off the band. It is then guided by rollers 18 to a washing station 19 at which the mesh is washed to remove electrolyte and any excess abrasive.

The endless band 12, after removal of the mesh 16, is washed at 20 and returns under the tank 10 to the input end of the tank. A tension roller 21 is provided for maintaining the required tension in the band.

During the electro-deposition process the metal band 12 acts as the cathode and is electrically connected at 22. Anodes 23 are located in the electrolyte 11 in the tank 10.

Abrasive is introduced into the tank at 24 to be brought into contact with the mesh over a central region of the operative portion of the band and any excess abrasive is washed off at 25 and is collected under the band at 26.

It will be appreciated that the mesh on the roll has already been applied with insulation over selected areas to define the areas over which deposition will take place in the tank.

The band 12 can be of any desired width according to the width of mesh to be used and the band defines a smooth electrically conductive surface over at least its upper surface of the operative portion. Because it is the mesh which is arranged to define areas over which deposition will take place the band surface is not required to carry any insulating material on its surface.

The production of mesh with discrete areas of metal and abrasive is continuous with this apparatus and changes in pattern of the discrete areas are easily achieved simply by changing the pattern on the mesh supplying the apparatus. The resulting mesh material is utilised in its various forms, according to the end use of the material, simply by cutting the mesh into the desired shapes, such as strips for abrading belts, rectangles for hand laps, discs, annulus shapes etc.

After the mesh has been formed with areas of metal and abrasive the remaining areas carrying insulating material may have the insulating material removed. This can be achieved by applying a solvent to the mesh which dissolves and removes the insulating material. In one arrangement the insulating material is removed so that adhesive may be applied to the mesh and may enter the openings in the mesh formerly occupied by the insulating matreial to be keyed to mesh material. The adhesive may then be used to attached a backing member to the mesh.

What we claim as our invention and desire to secure by Letters Patent of the United States is:

1. In a method of making an abrasive article a length of mesh material is laid onto an electrically conducting surface, metal is electro-deposited through the mesh and onto discrete areas of the mesh material lying on said surface in the presence of abrasive material so that the abrasive material becomes embedded in the discrete areas of metal and the metal is attached to the mesh, and after application of the metal and abrasive to the mesh material the mesh material is stripped off said surface to constitute the abrasive article, wherein the improvement comprises applying the mesh material with insulating material over areas of the mesh material before application to said surface so that the insulating material penetrates into and fills the openings in the mesh over said areas and the metal is only deposited over the remaining discrete areas of the mesh.

2. A method according to claim 1 wherein the insulating material is waterproof, acid resistant and stable at elevated temperatures at which the article is intended to be operated.

3. A method according to claim 1 wherein the insulating material is screen printed onto the mesh material to define said discrete areas of the mesh which are without insulating material.

4. A method according to claim 1 wherein the insulating material is resin or oil-based ink.

5. A method according to claim 1 wherein the insulating material is hot melt adhesive.

6. A method according to claim 5 wherein the adhesive is applied to the mesh in sheet form under heat, the sheet being formed with openings of the shape of the desired discrete areas before application to the mesh.

7. A method according to claim 6 wherein the sheet adhesive is applied to the mesh material under heat and pressure to absorb the adhesive onto the mesh material, the melt temperature of the adhesive being above the operating temperature of the abrasive article.

8. A method according to claim 5, wherein the abrasive member is applied with a backing member after removal from said surface, the backing member being adhered to the abrasive member by said adhesive.

9. A method according to claim 1 wherein the electrically conducting surface is formed as an endless movable band having an operative portion at one end of which the mesh material is laid on the band, the band over its operative portion passing through a bath of electrolyte for said deposition of metal and abrasive and the mesh being removed from the band after said deposition.

10. An abrasive article made according to the method of claim 1 comprising mesh material, discrete areas of electro-deposited metal extending through and carried on the mesh material and having abrasive material embedded in the metal, wherein the improvement comprises carrying insulating material on the remaining areas of the mesh material, the insulating material penetrating into the mesh and filling the mesh openings.

11. An abrasive article according to claim 10 wherein the insulating material is hot melt adhesive and a backing material is adhered to the mesh by said adhesive.

12. An abrasive article according to claim 10 wherein the mesh material is non-electrically conducting.

* * * * *

UNITED STATES PATENT AND TRADEMARK OFFICE

CERTIFICATE OF CORRECTION

PATENT NO. : 4,863,573

DATED : September 5, 1989

INVENTOR(S) : Michael W. Moore et al

It is certified that error appears in the above-identified patent and that said Letters Patent is hereby corrected as shown below:

Column 1, line 66, delete "providing" and insert --provided--.

Signed and Sealed this

Twenty-seventh Day of August, 1991

*Attest:*

HARRY F. MANBECK, JR.

*Attesting Officer*

*Commissioner of Patents and Trademarks*